US010197068B2

(12) United States Patent
Tazioli et al.

(10) Patent No.: US 10,197,068 B2
(45) Date of Patent: Feb. 5, 2019

(54) PUMPING DEVICE, PARTICULARLY FOR A DOMESTIC WATER SUPPLY

(71) Applicant: DAB PUMPS S.P.A., Mestrino (IT)

(72) Inventors: Stefano Tazioli, Localita Gabbro (IT); Francesco Sinico, Montecchio Maggiore (IT)

(73) Assignee: DAB Pumps S.P.A., Mestrino (IT)

( * ) Notice: Subject to any disclaimer, the term of this patent is extended or adjusted under 35 U.S.C. 154(b) by 888 days.

(21) Appl. No.: 14/175,805

(22) Filed: Feb. 7, 2014

(65) Prior Publication Data

US 2014/0241921 A1 Aug. 28, 2014

(30) Foreign Application Priority Data

Feb. 26, 2013 (IT) ..... PD2013A0044

(51) Int. Cl.
*F04D 29/42* (2006.01)
*F04D 1/00* (2006.01)
(Continued)

(52) U.S. Cl.
CPC ..... *F04D 29/426* (2013.01); *F04D 1/006* (2013.01); *F04D 13/16* (2013.01); *F04D 29/5813* (2013.01); *F04D 29/628* (2013.01)

(58) Field of Classification Search
CPC .. F04D 29/406; F04D 29/426; F04D 29/4266; F04D 29/60; F04D 29/605;
(Continued)

(56) References Cited

U.S. PATENT DOCUMENTS 2,428,256 A 9/1947 Yates
3,490,376 A * 1/1970 Valdespino ..... E02D 19/10 105/5
(Continued)

FOREIGN PATENT DOCUMENTS

CN 2215523 12/1995
CN 200961107 10/2007
(Continued)

OTHER PUBLICATIONS

Italian Search Report for IT PD20130044 dated Oct. 29, 2013.
Chinese Office Action, Application No. 201410061072.7, dated Mar. 22, 2017.

*Primary Examiner* — Bryan Lettman

(57) ABSTRACT

A pumping device arranged in a compact assembly that can be installed quickly and easily. The pumping device comprises a centrifugal electric pump, a pressurized vessel, and a manifold, wherein the pump, the vessel, and the manifold are enclosed in a single box-like body. The pump has two intake connectors arranged along perpendicular directions, and the pressurized vessel, for a delivery liquid, is fixed to the pump with an axis of symmetry that is parallel to the axis of the pump. The manifold has a one-way valve and is configured to distribute the delivery liquid to the pressurized vessel and to one of two delivery connectors that are oriented along perpendicular directions and are to be connected selectively or simultaneously to a hydraulic system. The intake connectors and the delivery connectors being in a single portion of the pumping device.

12 Claims, 7 Drawing Sheets

(51) Int. Cl.
*F04D 13/16* (2006.01)
*F04D 29/58* (2006.01)
*F04D 29/62* (2006.01)

(58) Field of Classification Search
CPC ..... F04D 29/62; F04D 29/628; F04D 13/16; F04D 1/006; F04D 29/4293; F04D 29/40; F04D 29/42; F04B 23/025; F04B 17/06; F04B 35/06; F04B 41/02; F04B 23/02; F04B 23/028
See application file for complete search history.

(56) References Cited

U.S. PATENT DOCUMENTS

| | | | | |
|---|---|---|---|---|
| 7,124,775 | B2 * | 10/2006 | Chang | F04D 13/16 137/559 |
| 2004/0149339 | A1 | 8/2004 | Chang | |

FOREIGN PATENT DOCUMENTS

| | | | |
|---|---|---|---|
| CN | 101696693 | | 4/2010 |
| CN | 102817856 | | 12/2012 |
| WO | WO2012001711 | * | 1/2012 |

* cited by examiner

PUMPING DEVICE, PARTICULARLY FOR A DOMESTIC WATER SUPPLY

The present invention relates to a pumping device, particularly for a domestic water supply.

As is known, the supply of a domestic hydraulic system typically requires at least one electric pump, which can be a centrifugal single-stage or multistage pump, i.e., provided with a plurality of impellers alternated with diffusers. The operation of the electric pump is usually managed manually, by means of a pressure-controlled switch or a pressure/flow-controlled switch, or by means of inverter-based electronics.

These elements compose, often in combination also with a membrane accumulation tank, a pumping device to be connected with the intake and delivery to portions of the hydraulic system.

The configurations typically used in installation are not flexible from the point of view of operation, since the electric pump is designed to be arranged with an axial intake and a tangential delivery, or vice versa, or so that both are axial, on opposite sides of the electric pump.

Currently, in fact, the market offers devices in the form of already-assembled pumping assemblies, preset for installation so that the pump axis, i.e., the impeller rotation axis, is in a vertical position or for horizontal installation, according to the requirements, in which the components are already mounted on a single footing.

As an alternative, the installation technician can purchase the individual components or subassemblies from different suppliers, in order to assemble and install the device on site.

In both cases, the installation technician is forced to perform a survey to establish which type of pumping assembly is most suitable or to design it.

Another disadvantage of these devices is linked to the final space occupation, which is partly due to assembly constraints for vertical or horizontal installation, partly due to the adapted connectors by means of which the components are associated, and partly due to the components themselves, both main and auxiliary.

Such components can be the devices for detecting the values of the delivery fluid from the electric pump or fan-based cooling systems for the motor of the electric pump or of the inverter, which, as is known, are not only bulky but also noisy.

The aim of the present invention is to provide a pumping device in a compact assembled assembly, which comprises in a single structure all the above-cited components, reducing overall space occupation, and lends itself to be installed both with the pump axis in a horizontal configuration and in a vertical configuration, according to the requirements, reducing the survey efforts for the installation technician.

Within this aim, an object of the invention is to provide a pumping device that can be installed quickly and easily.

Another object of the invention is to provide a device that facilitates some particular maintenance operations.

A further object of the invention is to propose a device with a reduced noise level with respect to those currently known and in use.

This aim, as well as these and other objects that will become more apparent hereinafter, are achieved by a pumping device, particularly for a domestic water supply, to be installed in a hydraulic system, characterized in that it comprises:

a centrifugal electric pump, which has two intake connectors arranged along perpendicular directions and to be connected selectively to said hydraulic system, a tank for the delivery liquid, which has a substantially cylindrical shape and is fixed to said centrifugal electric pump with an axis of symmetry that is substantially parallel to the axis of the pump, a manifold, provided with a one-way valve, intended to distribute the delivery liquid to said tank and to one of two delivery connectors that are oriented along perpendicular directions and are to be connected selectively or simultaneously to said hydraulic system, said intake connectors and said delivery connectors being mutually close in a single portion of said pumping device, substantially a portion for connection to said hydraulic system.

Further characteristics and advantages of the invention will become more apparent from the description of a preferred but not exclusive embodiment of the pumping device according to the invention, illustrated by way of non-limiting example in the accompanying drawings, wherein.

Figure 1:
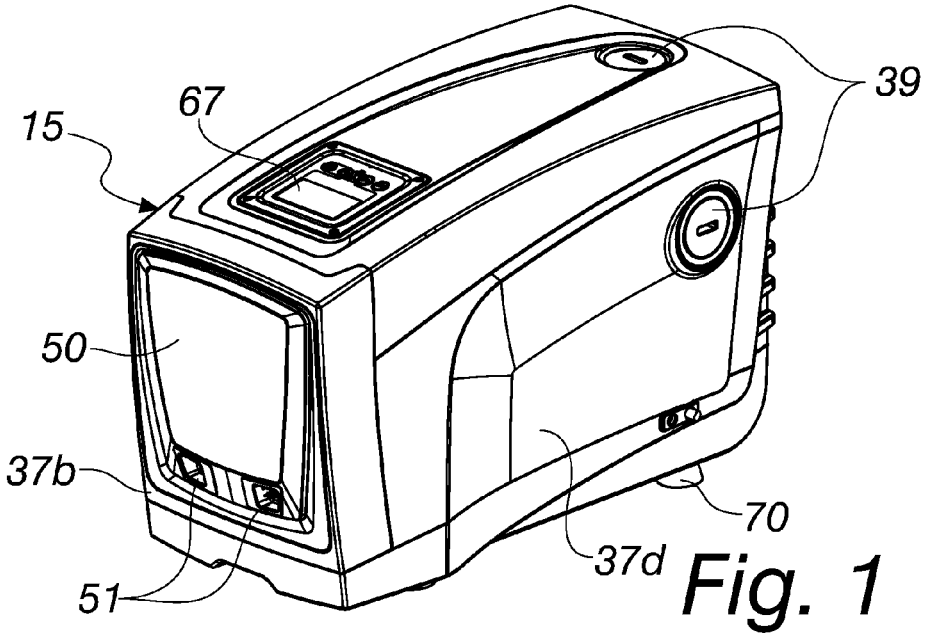
FIG. 1 is a perspective view of the pumping device according to the invention.

With reference to the cited figures, the pumping device according to the invention, generally designated by the reference numeral 10, comprises a series of mutually connected elements, which include: a centrifugal electric pump 11, a tank 12 for the delivery liquid, a manifold 13 on which a pressure transducer 14 is installed, all enclosed within a single box-like body 15.

The centrifugal electric pump 11 has two intake connectors 16*a* and 16*b* (shown in FIG. 8), which are arranged along perpendicular directions and are to be connected selectively to a hydraulic system.

Figure 13:
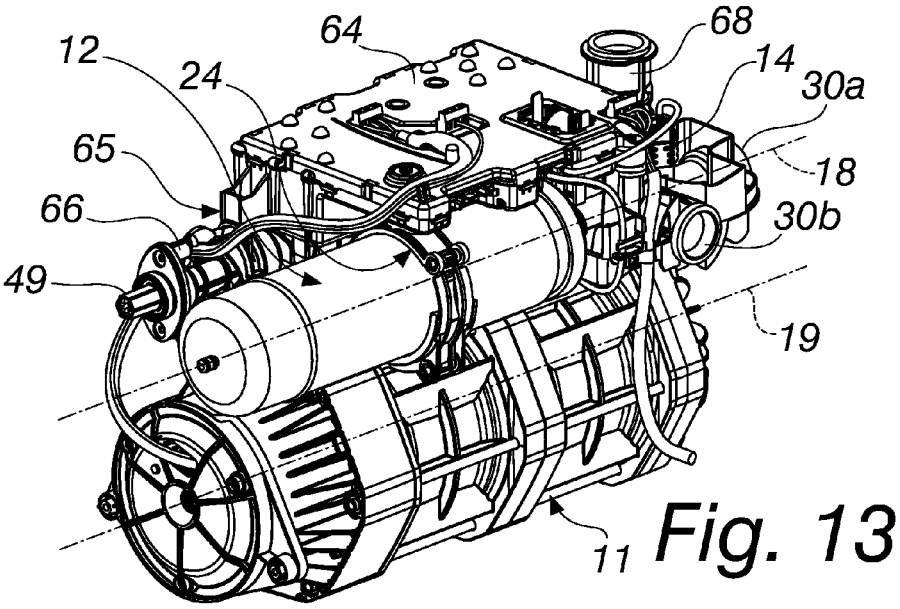
FIG. 13 is a perspective view of the pumping device according to the invention, without a box-like body that encloses it.

The tank 12 has a substantially cylindrical shape and is fixed to the centrifugal electric pump 11 by means of adapted quick fixing means 17 (shown in FIG. 9), with an axis of symmetry 18 that is substantially parallel to the axis of the pump 19, as is clearly visible in FIG. 13.

Figure 8:
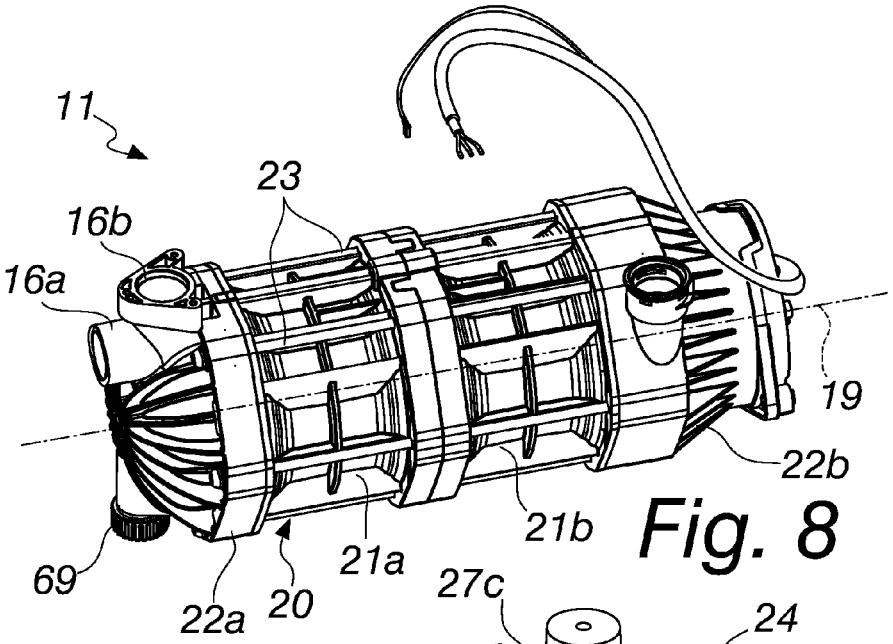
FIG. 8 is a perspective view of the centrifugal electric pump.

In particular, the centrifugal electric pump 11, shown on its own in FIG. 8, is of the multistage type enclosed in a shell 20 for the containment of an assembly of impellers and of a motor that makes them rotate about the pump axis 19. More particularly, the shell 20 comprises a substantially cylindrical portion that surrounds the impellers and the motor and is constituted by two jackets 21*a* and 21*b* (respectively closer to the intake and to the delivery) that are coupled on the transverse plane and comprises correspondingly also two opposite heads 22*a* and 22*b* that close the end faces of the cylindrical portion respectively at the intake and at the delivery of the centrifugal electric pump 11. The two jackets 21*a* and 21*b* and the two heads 22*a* and 22*b* are joined by means of tension members 23, which pass through them in succession and to which the tank 12 is fixed by the adapted quick fixing means 17, shown in FIG. 9.

Figure 9:
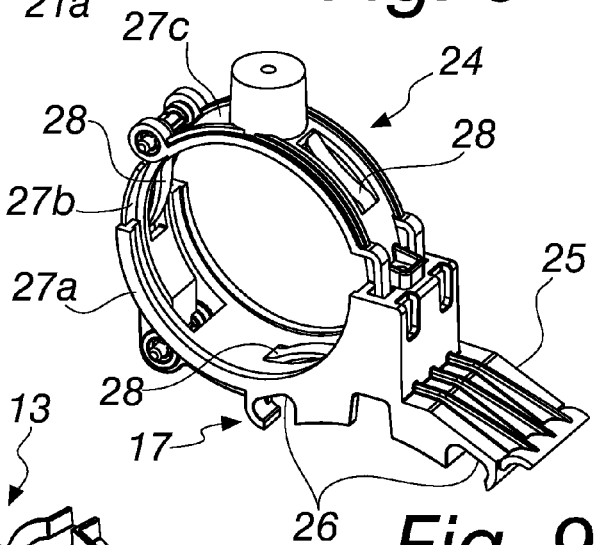
FIG. 9 is a perspective view of a collar for fixing the tank to the centrifugal electric pump.

The association of the tank 12 with the centrifugal electric pump 11 is shown in the overall view of FIG. 13 and occurs by means of a band-like fixing collar 24, shown on its own in FIG. 9, that surrounds it and is provided with the quick fixing means 17, which comprise a lateral protrusion 25 on which seats for quick snap engagement 26 with the tension members 23 are provided, the fixing collar 24, with the lateral protrusion 25, being made of plastic material and being therefore elastically yielding for engagement.

In particular, the fixing collar 24 is constituted, in the example provided and illustrated in FIG. 9, by three crescent-shaped elements 27*a*, 27*b*, 27*c* in series, which are associated by means of two hinges in a position that is not diametrically opposite so as to minimize diametrical space occupation, which close by surrounding the tank 12 and are provided with arc-like elastic compensation elements 28 that substantially consist of cantilevered curved tabs in order to compensate for the dimensional tolerances of the tank 12.

Figure 10:
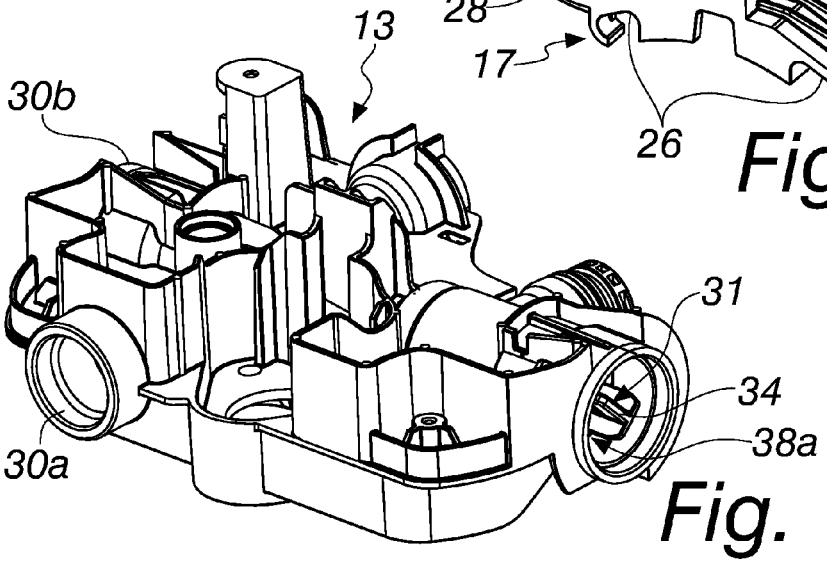
FIG. 10 is a view of the manifold on its own.
Figure 11:
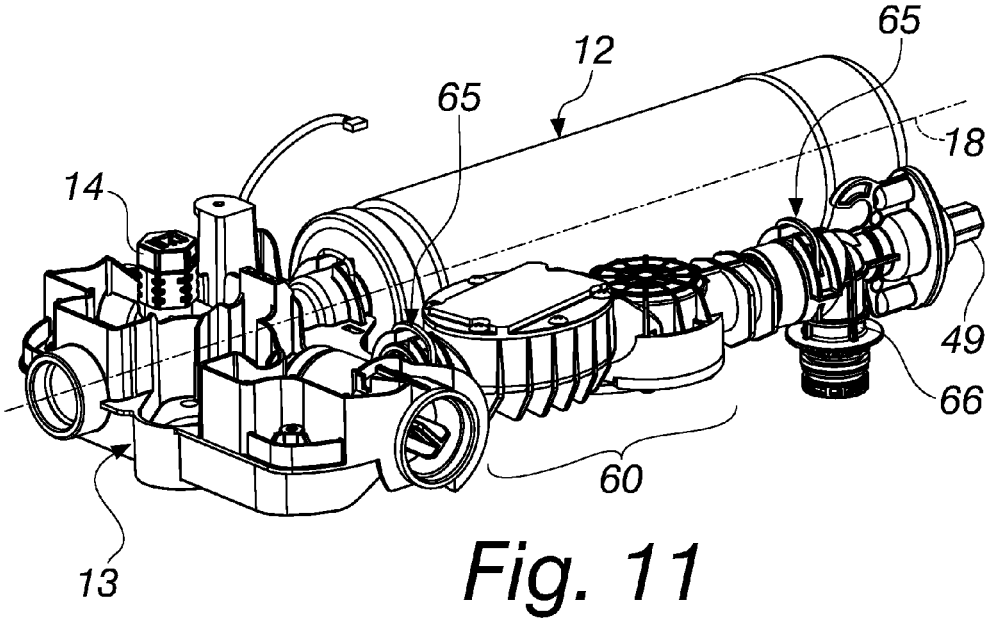
FIG. 11 is a perspective view of an assembly provided by the association of the tank, the manifold and a control apparatus that is fitted on a single monolithic portion traversed by the delivery liquid.

The manifold 13, shown on its own in FIG. 10 and in its association with the tank 12 in FIG. 11, is provided with a one-way valve 29 (shown in FIG. 6 and not visible in FIG. 10 because it is inserted in a portion of the manifold 13) and is designed for the distribution of the delivery liquid (its connection to the delivery is shown in FIG. 11 and is described in more detail hereinafter) to the tank 12 and to one of two possible delivery connectors 30*a* and 30*b*, or to both, which are part of the same manifold 13 but are oriented along perpendicular directions and are to be connected selectively or simultaneously to the hydraulic system.

Figure 6:
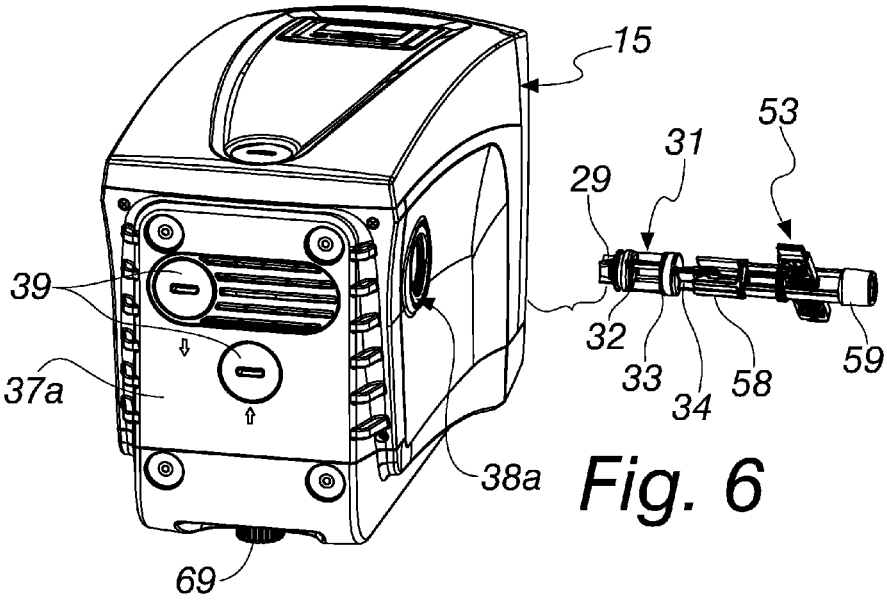
FIG. 6 is a view of the use of the tool of the preceding figure during the extraction of a component of the pumping device according to the invention.

The one-way valve 29 is inserted in a portion of the manifold 13 with a cartridge 31 that is also shown in FIG. 6, which shows the extraction of the one-way valve 29 from the pumping device 10. The cartridge 31 is of the type with an elongated body that comprises a first portion 32, which supports the one-way valve 29 and by means of which it enters the portion of the manifold 13 (FIG. 10), and a second portion 33, from which a grip portion 34 protrudes which remains in a part that is dry and not traversed by liquid, substantially an extension of the portion in which the one-way valve 29 is inserted, for the extraction of said cartridge 31 with the one-way valve 29.

As shown in FIG. 11, the pressure transducer 14 is installed on the manifold 13 in order to measure the value of the delivery pressure.

As can be noted, it has a substantially hexagonal cross-section and lends itself to be screwed in and unscrewed by means of a simple hexagonal key.

Furthermore, the pressure transducer 14 has a limited space occupation, of the type that has on the inside a flat functional element with an internal membrane portion that is subjected to the pressure of the liquid that enters the transducer, and an electronic board that is installed on the functional element at right angles to the internal membrane portion and is designed, as is known, to transduce the pressure of the liquid on the membrane.

Figure 2:
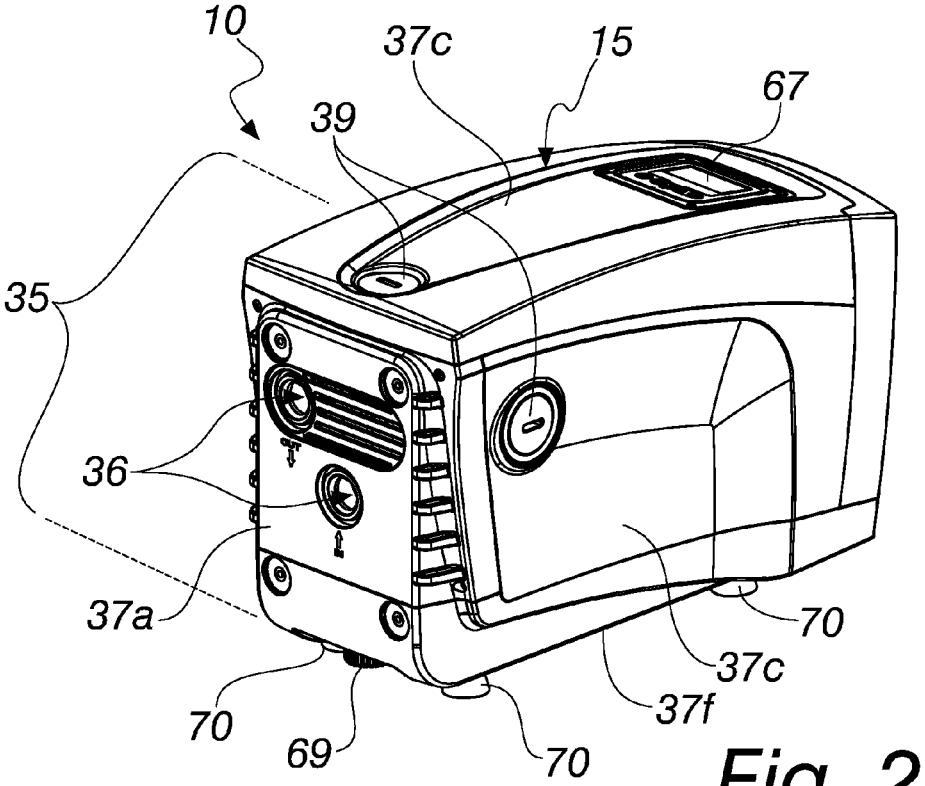
FIG. 2 is a view of the pumping device according to the invention, from the opposite side with respect to the preceding figure.
Figure 3:
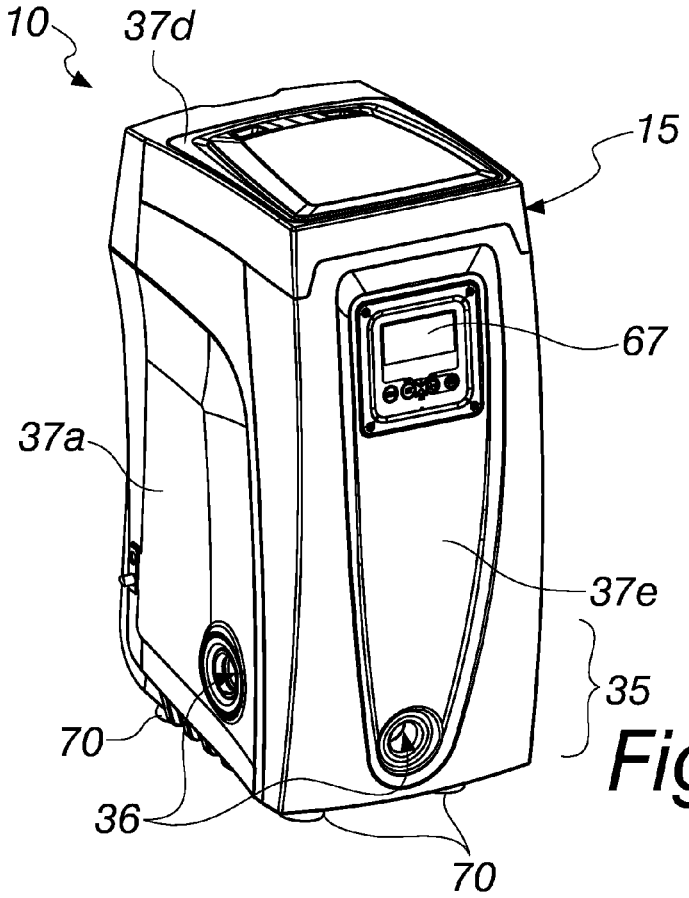
FIG. 3 is another perspective view of the pumping device according to the invention in another position.

As can be noted, the intake connectors 16*a*, 16*b* and the delivery connectors 30*a*, 30*b* are close to a single portion of the pumping device 10, substantially a portion 35 for connection to the hydraulic system (shown in FIG. 2 and in FIG. 3).

Figure 4:
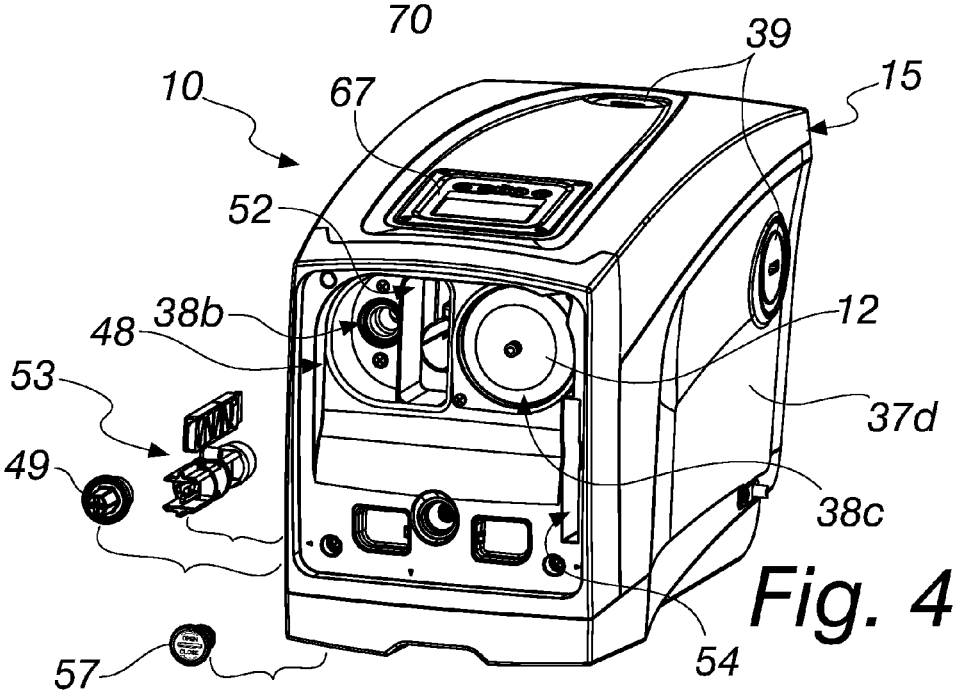
FIG. 4 is a view of the pumping device according to the invention, shown partially open.

The box-like body 15 is provided with adapted openings 36 at the mouths of the intake connectors 16*a*, 16*b* and of the delivery connectors 30*a*, 30*b*, which are close in the connection portion 35 to a first wall 37*a*, and with access points 38, more particularly three access points 38*a*, 38*b* and 38*c*, for the operations for maintenance of the pumping device. The openings 36 are shown in FIGS. 2 and 3 and the access points 38 are shown in FIGS. 4 and 6.

In particular it should be noted that the first wall 37*a* has an opening 36 for an intake connector 16*a* and an opening 36 for a delivery connector 30*a*, while the remaining intake connector 16*b* and delivery connector 30*b* each terminate in an opening 36 in a wall that is contiguous to the first wall 37*a*.

Such openings 36 and a first access point 38*a* shown in FIG. 6 (for the cartridge 31 with one-way valve 29) can be closed by means of adapted plugs 39.

Figure 7:
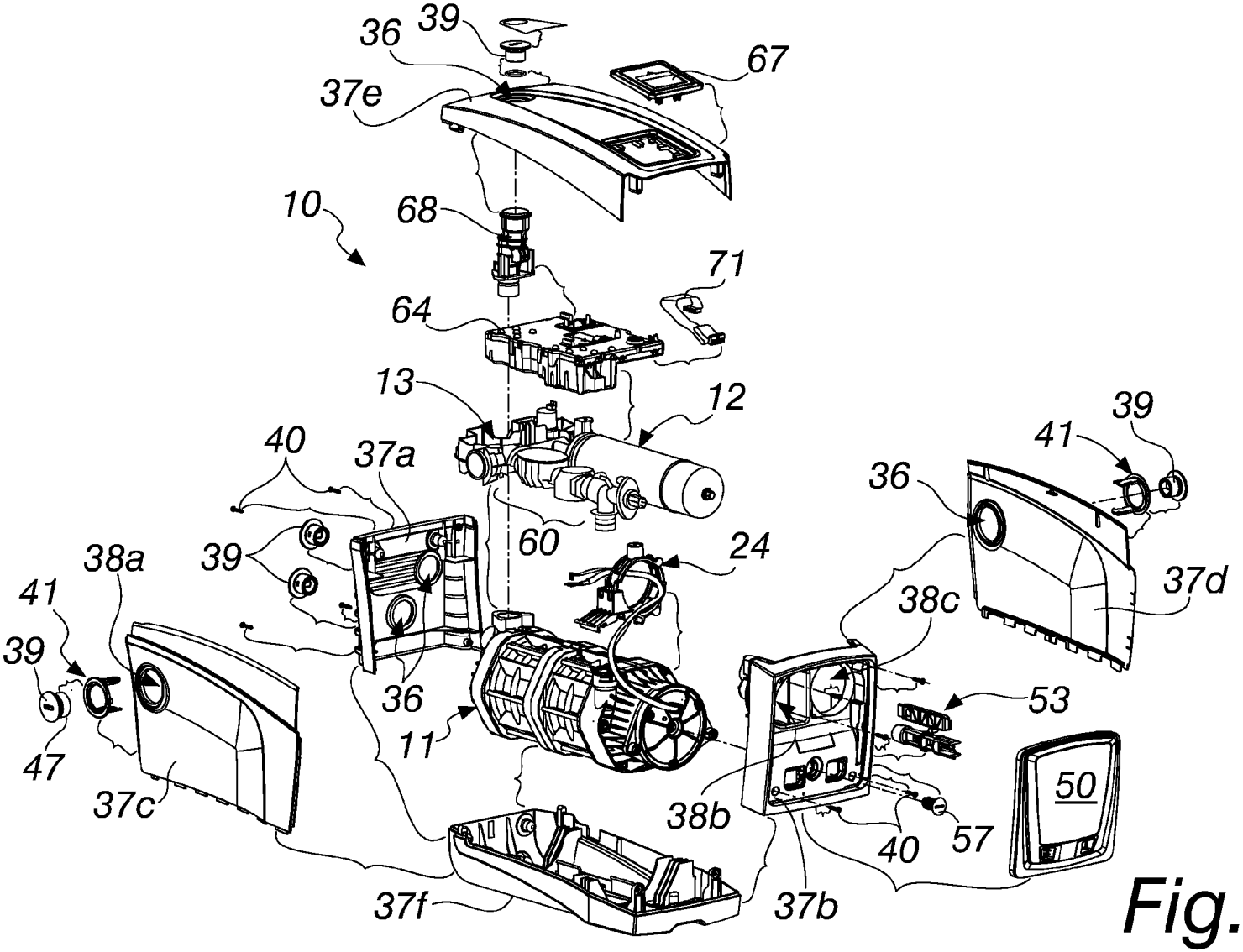
FIG. 7 is an exploded perspective view of the pumping device according to the invention.

The box-like body 15 has substantially the shape of a parallelepiped that can be closed by the connection of its walls 37*a*, 37*b*, 37*c*, 37*d*, 37*e*, 37*f* by adapted closure means, which are clearly visible in the exploded view of FIG. 7, such as fixing screws 40 or means 41 for the quick association of said walls 37*c* and 37*d* with internal elements of said pumping device 10.

Figure 14:
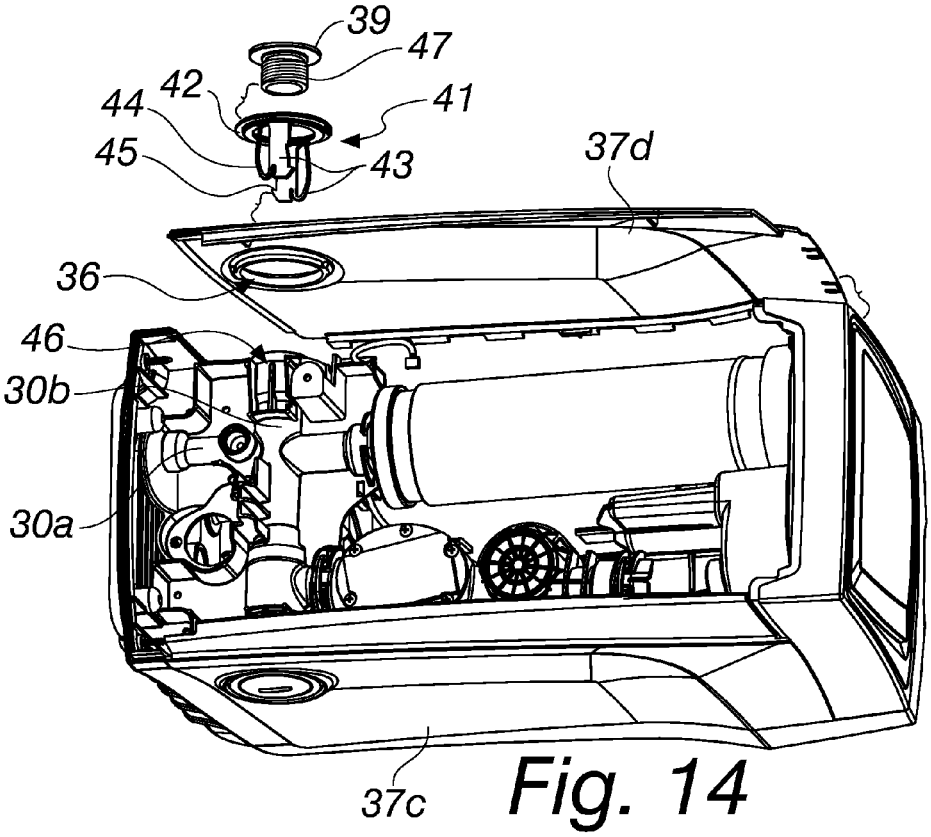
FIG. 14 is a perspective view of the pumping device with the box-like body open in order to show the application of adapted clips.

The quick connection means 41 consist substantially of a clip (better visible in FIG. 14, from which it becomes clear how this type of closure occurs), with a head 42 having a circular perimeter and from which two flat stems 43 protrude substantially at right angles thereto and from mutually opposite points, the clip entering with said stems an opening 36, such as the one arranged at the mouth of a delivery connector 30*b*, or the first access point 38*a*, shown on the left of the drawing of FIG. 7.

The clip is made of plastic material and has, on its two flat stems 43, a portion 44 that is elastically deformable during insertion and means 45 for quick snap engagement with an adapted accommodation portion 46 for the flat stems 43, which substantially consist of a tooth, for each stem, that enters by snap action an adapted seat of the accommodation portion 46 of the pumping device 10.

More particularly, the clip has a head 42 that has a substantially annular shape and engages, by means of its edge, the edge of the opening 36 or of the access point 38*a*, and is designed to accommodate the stem 47 of an adapted plug 39.

The centrifugal electric pump 11 and the tank 12 are arranged inside the box-like body 15 respectively with the pump axis 19 and the axis of symmetry 18 of the tank 12 substantially at right angles to two opposite walls 37*a* and 37*b* of the box-like body 15. As shown in FIG. 2, in a first wall 37*a* of the two walls there are two openings 36 for the connection of the intake connector 16*a* and of the delivery duct 30*a* of the centrifugal electric pump 11 respectively to the intake duct and to the delivery duct of the hydraulic system, while the second wall 37*b*, as can be seen in FIG. 4, is provided with a technical compartment 48 with some access points 38, which include a second point 38*b* of access to the closure plug 49 of a loading opening of the pump body during installation of the pumping device with the pump axis 19 arranged vertically and a third point 38*c* of access to the tank 12.

The technical compartment 48 can be accessed by means of a door 50, shown in FIG. 1, that can be opened by means of adapted release means that can be accessed from two access openings 51.

The technical compartment 48 is also provided with a receptacle 52 for a tool 53, of the multipurpose manual type, and with a pocket 54 for a folded user guide.

Figure 5:
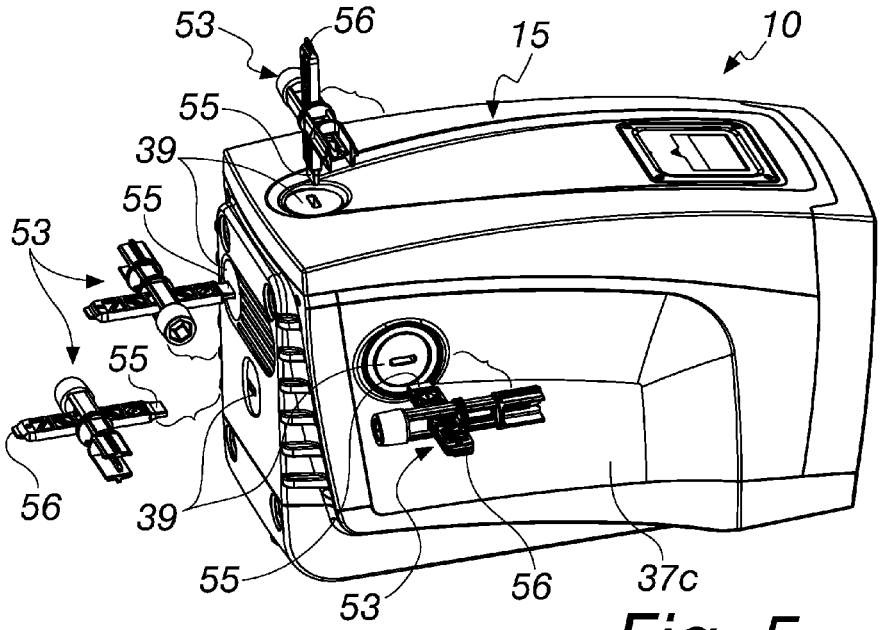
FIG. 5 is a view of the use of a manual tool for opening and maintaining the pumping device according to the invention.

The tool 53 comprises two elongated elements, each of which supports portions of keys of tools, in order to be associated transversely with each other, as shown in FIGS. 5 and 6, so as to determine at least one cross-shaped configuration for use for the tool 53.

In the inactive configuration, the two elements are instead stored parallel to each other in the adapted spaces of the receptacle 52 and initially are offered to the user joined by a connecting element, as shown in FIG. 4, which must be broken upon first use.

In particular, from the first figures, which show the pumping device 10 substantially assembled, it can be noted that the plugs 39 that close the windows 36 of the intake connectors 16*a*, 16*b* and delivery connectors 30*a*, 30*b* and the extension of the portion of manifold 13 in which the cartridge 31 is inserted have on the outside of the head a notch, in order to be screwed in and unscrewed by means of the tool 53, in the configuration for use, which for this purpose is provided with a first flat screwdriver tip 55 of appropriate dimensions. By means of an opposite second flat screwdriver tip 56, the tool 53 makes it possible to unscrew another plug 57, shown in FIG. 4, in order to access the driving shaft of the centrifugal electric pump 11 from the technical compartment 48.

As is clearly visible in FIG. 6, at another end the tool 53 has a fork-like engagement portion 58 by means of which it engages advantageously the grip portion 34 of the cartridge 31 to extract it with the one-way valve 29.

At the end that is opposite the end of the fork-like engagement portion 58, the tool 53 is provided with a socket head key 59, for unscrewing and screwing in the closure plug 49 of the loading opening of the pump body, which has a protruding polygonal portion that has a hexagonal cross-section.

Figure 12:
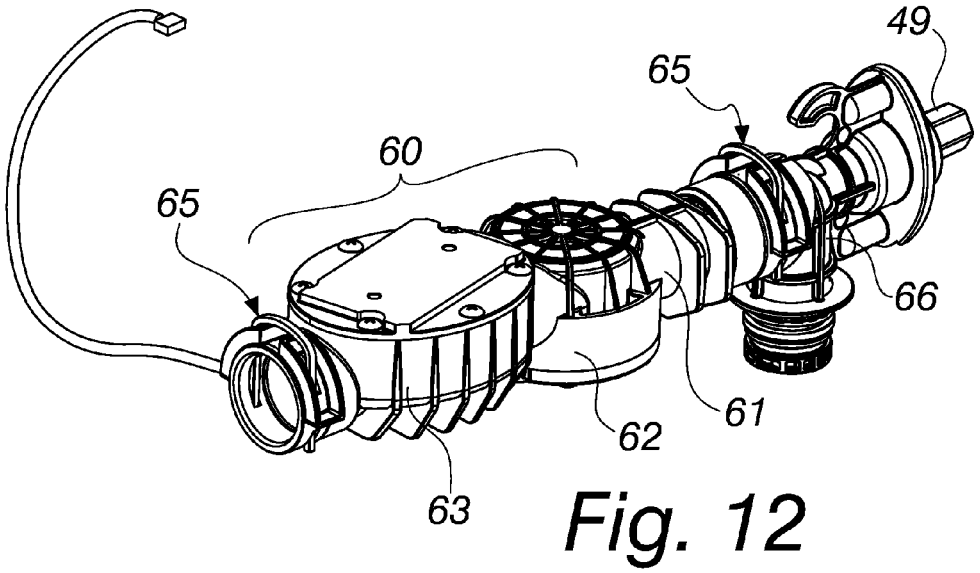
FIG. 12 is a view of the control apparatus associated with a connector.

More precisely, within the box-like body 15 the pumping device 10 also comprises an apparatus 60, which is clearly visible in FIG. 11 and in FIG. 12 and in turn comprises, on a single monolithic portion 61 of duct traversed by delivery liquid of the centrifugal electric pump 11, flow-rate detection means 62, which consist substantially of a flowmeter, and a heat sink 63 for a control and monitoring unit 64 of the pumping device, which also is enclosed in the box-like body 15.

The control and monitoring unit 64 is shown in FIG. 13 and is provided on the inside, not visible, with a temperature sensor, for detecting the operating temperature of the device, as will be described in more detail in operation.

Moreover, FIG. 11 and FIG. 12 designate means 65 for quick and reversible connection by means of which the monolithic portion 61, provided with the apparatus 60, is connected to the delivery of the centrifugal electric pump 11 by means of a connector 66 on the intake side of the liquid and to the manifold 13 on the discharge side.

The connector 66 is provided with an opening for loading the pump body in the vertical installation, which corresponds to the arrangement with the pump axis 19 substantially vertical and can be closed, as anticipated, by means of the closure plug 49, which can be screwed in and unscrewed by means of the tool 53 and can be accessed from the technical compartment 48.

The opening allows loading of the pump with liquid up to the intake region.

The quick and reversible connection means 65 consist substantially of U-shaped forks that pass at least partially through pairs of end portions thereof that are inserted into each other.

In FIGS. 1 to 6 and in the exploded view of FIG. 7, it can be noted that the pumping device 10 is also provided with a user interface 67, which is connected to the control and monitoring unit 64. In the illustrated case, the user interface 67 is connected by means of a flat cable 71 and can be arranged in its adapted receptacle provided in the fifth wall 37*e*, which corresponds to the upper one in the horizontal installation and to the front one in the vertical installation.

FIG. 13 illustrates the pumping device 10 without the box-like body 15, in which the internal elements described above are mutually associated according to a specific composition.

In particular, it can be noted that the tank 12 is associated with the centrifugal electric pump 11 by means of the fixing collar 24, with an axis of symmetry 18 that is substantially parallel to the axis of the pump 19; the connector 66 is associated with the delivery of the centrifugal electric pump 11 and the plug 49 for closing the loading opening protrudes from it on the rear part; as shown more clearly in FIG. 11, the monolithic portion 61 with the apparatus 60 is connected, also by means of the quick and reversible connection means 65, to the connector 66 and on the opposite side to the manifold 13, by means of which, as shown, the delivery is connected to the tank 12. Moreover, in the upper part, with respect to the illustration of FIG. 13, the control and monitoring unit 64 is installed and its temperature is controlled by means of the heat sink 63 of the apparatus 60 on which it rests (not visible since it is hidden by the tank 12).

It can also be noted that the second intake connector 16*b* of the centrifugal electric pump 11 is extended upward, again with respect to the illustration, by means of an extension 68 that passes through the manifold 13. The latter brings the first delivery connector 30*a* to said first wall 37*a* of the box-like body 15 on which the first intake connector 16*a* ends and brings the second delivery connector 30*b* to the fourth wall 37*d*, in a direction that is perpendicular to the first delivery connector 30*a*.

The centrifugal electric pump 11 can be, as in the case described here, of the self-priming type, and in this regard it can be noted from FIG. 6 and from FIG. 8 that it is provided advantageously, in a downward region relative to said figures, with a plug 69, which can be screwed on from the outside of the device and is to be made to cooperate with a flow control element, not visible from the outside, of a valve designed to open and close a duct for recirculation from the impeller assembly to the intake. The screw-on plug 69 is preferably of the type provided internally with a mushroom-shaped element, the axial space occupation of which forms for said screw-on plug 69 two alternative axial positions for overhead or underhead installation of the centrifugal electric pump 11.

Moreover, in the figures that show the pumping device 10 complete with the box-like body 15, one can notice the presence of four resting feet 70, which act as vibration-damping pads and can be associated with the box-like body 15 at the first wall 37*a* or at the sixth wall 37*f*, depending on whether the device is installed vertically or horizontally.

The use of the pumping device according to the invention is as follows.

Depending on the requirements, the device can be installed either in an overhead configuration or in an underhead configuration and so that the pump axis 19 is in a horizontal position, as in most of the accompanying figures, or in a vertical position, as in FIG. 3.

The screw-on plug 69, to be made to cooperate with the flow control element, can be accessed easily from the outside, as can be seen in FIGS. 2 and 6, and can be reversed according to the two alternative axial positions for use of the centrifugal electric pump 11 in the overhead or underhead configuration.

In the case of underhead installation, the flow control element keeps the valve closed, being pushed by the mushroom-shaped element of the screw-on plug 69 against the opening of the recirculation duct, in order to make the self-priming centrifugal electric pump 11 work like a normal centrifugal pump designed exclusively for operation in underhead configuration.

By opening the door 50 it is possible to access the technical compartment 48 in order to extract the tool 53 from the corresponding receptacle 52 or extract the user guide from the pocket 54 or also for maintenance operations, such as loading the pump body or refilling the tank 12.

Once it has been assembled in a cross-shaped configuration, the tool 53 can be used with its socket head key 59 to unscrew the closure plug 49 or the other plug 57 for access to the driving shaft of the pump by means of the second flat screwdriver tip 56.

Again depending on the installation requirements, each one of the two intake connectors 16*a*, 16*b* and of the two delivery connectors 30*a*, 30*b* can be rendered active simply by opening their openings outward, i.e., by unscrewing the plugs 39, preferably with the first flat screwdriver tip 55 of the tool 53, and by connecting them to the system. This use of the tool 53 is shown in FIG. 5 and the same figure also shows the opening of the first access point 38*a* to the extension in which the one-way valve 29 is stored, which occurs again by unscrewing a plug 39 of the same type. As shown in the subsequent figure, by means of the same tool 53, and in particular by means of its fork-shaped engagement portion 58, it is possible to extract the cartridge 31 with the one-way valve 29, for any operations for cleaning or replacing it.

The clips that engage the third wall 37*c* and the fourth wall 37*d* of the box-like body 15 with the manifold 13, and more particularly respectively with the second delivery connector 30*b* and with the extension for the one-way valve 29, remain instead integral with said walls until the maintenance operations require their disengagement for opening of the box-like body 15.

It should be noted that the pumping device 10, assembled as described, makes it possible to enclose in a single box-like body 15 the centrifugal electric pump 11, the tank 12 and the electronic part in order to propose an assembly that is already assembled and ready to be installed with the pump axis 19 horizontal or vertical, facilitated by the presence, on a single face, of an intake connector and of a delivery connector.

The pumping device 10 is an extremely compact product, ready to be installed simply by connecting its most suitable intake and delivery connectors to the hydraulic system. The product is proposed with the intake and delivery connectors closed by the plugs 39, to be removed according to the installation requirements.

It should also be noted that the compactness of the product is due to the arrangement of the components inside the box-like body 15, to their very shape and to the way in which they are mutually associated.

It should also be noted that the pumping device 10 does not comprise ventilation systems for cooling the motor of the centrifugal electric pump 11, which is instead affected by the liquid that exits from the impeller assembly, or for the cooling of the control and monitoring unit 64, the excess heat of which is dissipated by means of the heat sink 63 of the apparatus 60, which is affected by the liquid that passes through the monolithic portion 61. This particularity allows not only to reduce significantly the space occupation of the pumping device 10 but also to reduce considerably the noise of the device.

Moreover, the apparatus 60 is capable of detecting the flow-rate of delivery liquid with the help of the flow-rate detection means 62 and the pressure transducer 14 installed on the manifold 13 provides the spot value of the pressure.

Moreover, the temperature sensor, connected to the control and monitoring unit 64, allows monitoring of the operating temperature of the device and, in case of excessive heating of the electronic parts or of excessive cooling of the operating environment, said unit controls the switching off or on of the centrifugal electric pump 11, in the second case to prevent the liquid that is present in the ducts from reaching the freezing point, damaging the device.

Many of the components are made preferably of plastic material, such as for example the manifold 13, the monolithic portion 61, the connector 66, the shell 20 and the box-like body 15 itself, limiting as much as possible the weight of the pumping device 10.

In practice it has been found that the invention achieves the intended aim and objects, providing a pumping device in an assembly that is already assembled and ready to be installed quickly and easily, is compact and has a smaller overall space occupation than currently known devices, thanks to the particular assembly configuration of the components, to the means used for their association and to the particular structure of said components.

Moreover, the structure of the device, due to the way in which it is assembled and due to the presence of multiple intake and delivery connectors arranged along perpendicular directions, lends itself to be installed both with a vertical pump axis and with a horizontal pump axis.

Moreover, this particular structure facilitates some particular maintenance operations of the device, such as cleaning or changing the one-way valve, thanks to the adapted cartridge that facilitates its extraction, or the loading of the pump by means of the loading access point that is hidden by the door or access point to the axis of the motor.

Another advantage of the pumping device according to the invention is that it proposes a device with a reduced noise level, thanks to the absence of fan-based systems for cooling the motor or the electronic unit, both of which are replaced by water cooling.

It should also be noted that the noise of the pump is reduced by the presence of the enclosure itself that contains the device, i.e., by the box-like body.

A further advantage of the pumping device according to the invention arises indeed from the reduced noise level and from its compactness, which allow its installation even within a home, for example under the sink or under the stairs, where the reduced quantity of air does not constitute a hindrance for a water-cooled device.

Another advantage of the pumping device is that it has openings for the intake and delivery connectors at a single connection portion and more particularly the openings of an intake connector and of a delivery connector on a single wall, facilitating quick connections to the ducts of the system.

In this manner, the product can be installed on a wall easily, optionally by means of adapted fixing accessories.

Another advantage is that it is provided with a user interface that allows in real time the adjustment and control of the operation of the device. Moreover, the user interface can be oriented in four positions, rotating by 90° in steps of 90° and always with the display directed toward the outside of the box-like body.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to the requirements and the state of the art.

The disclosures in Italian Patent Application No. PD2013A000044 from which this application claims priority are incorporated herein by reference.

What is claimed is:

1. A pumping device for a domestic water supply, comprising:

a centrifugal electric pump, which has two intake connectors arranged along perpendicular directions, a pressurized vessel for a delivery liquid, which has a cylindrical shape and is fixed to said centrifugal electric pump with an axis of symmetry that is parallel to an axis of the pump, a manifold, provided with a one-way valve, intended to distribute the delivery liquid to said pressurized vessel and to one of two delivery connectors that are oriented along perpendicular directions, said intake connectors and said delivery connectors being in a single portion of said pumping device, wherein said centrifugal electric pump, said pressurized vessel, and said manifold are enclosed in a single box-like body provided with adapted openings at mouths of said intake connectors and of said delivery connectors, which are in or adjacent to a connection portion to a first wall of said box-like body, which has an opening for one of said intake connectors and an opening for one of said delivery connectors, said box-like body being also provided with access points for the maintenance operations of said pumping device, said openings and at least one of said access points being closed from an outside by means of plugs;

said centrifugal electric pump and said pressurized vessel are arranged inside said box-like body respectively with the axis of the pump and the axis of symmetry of the pressurized vessel perpendicular to two opposite walls of said box-like body, comprising said first wall provided with two of said openings for a connection of a first intake connector and of a first delivery connector of said centrifugal electric pump, and a second wall of said two opposite walls provided with a technical compartment with further access points, which include an access point to a plug for closing an opening for loading said centrifugal electric pump and another point of access to said pressurized vessel.

2. The pumping device according to claim 1, wherein said box-like body is shaped like a parallelepiped that is closed by a connection of its walls by adapted closure means, such as fixing screws or a clip for a quick connection of said walls with internal elements of said pumping device.

3. The pumping device according to claim 1, wherein said technical compartment is provided with a receptacle for a tool, of a manual multipurpose type, and with a pocket for a folded user guide.

4. The pumping device according to claim 3, wherein said plugs have, externally on a head thereof, a notch in order to be screwed and unscrewed by said tool.

5. The pumping device according to claim 1, wherein said technical compartment is accessed by means B of a door that is opened by a release means.

6. The pumping device according to claim 1, further comprising, inside said box-like body, an apparatus which in turn comprises, on a single monolithic portion of the duct traversed by delivery liquid, means for detecting the flow-rate and a heat sink for a control and monitoring unit of the pumping device, said monolithic portion being connected to the delivery of said centrifugal electric pump and, at the opposite end, to said manifold by means for quick and reversible connection.

7. The pumping device according to claim 6, wherein said monolithic portion is connected to the delivery of said centrifugal electric pump by a connector.

8. The pumping device according to claim 7, wherein said closure plug of said opening for loading said centrifugal electric pump has a protruding polygonal portion in order to be screwed and unscrewed by means of an appropriate tool.

9. The pumping device according to claim 6, wherein it is provided with a user interface connected to said control and monitoring unit.

10. The pumping device according to claim 1, wherein said centrifugal electric pump is enclosed in a shell for containing an assembly of impellers and of a motor that turns them around said pump axis, which comprises a substantially cylindrical portion, which surrounds said assembly of impellers and said motor and is constituted by two jackets that are coupled on a transverse plane and also comprises two opposite heads, which close end faces of the cylindrical portion respectively at the intake and at the delivery of said centrifugal electric pump, said two jackets and said two heads being joined by means of tension members that pass through them at least partially and in succession and to which said pressurized vessel is fixed by quick fixing means.

11. The pumping device according to claim 10, wherein said pressurized vessel is fixed to said shell by means of a band shaped fixing collar that surrounds it and is provided with said quick fixing means, which comprise a lateral protrusion on which seats for quick snap engagement with said tension members are provided.

12. The pumping device according to claim 1, wherein said one-way valve is inserted in a portion of said manifold with a cartridge that has the appearance of an elongated body that comprises a first portion, which supports the one-way valve and with which it enters the portion of the manifold, and a second portion, from which a grip portion protrudes which remains in a part that is not traversed by liquid, for the extraction of said cartridge with said one-way valve.

* * * * *